US007335135B2

(12) United States Patent
Wang

(10) Patent No.: US 7,335,135 B2
(45) Date of Patent: Feb. 26, 2008

(54) TREADMILL BELT LUBRICATING DEVICE FOR AN ELECTRIC TREADMILL

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 113 days.

(21) Appl. No.: 11/314,653

(22) Filed: Dec. 22, 2005

(65) Prior Publication Data

US 2007/0149363 A1 Jun. 28, 2007

(51) Int. Cl.
*A63B 22/02* (2006.01)
*A63B 71/00* (2006.01)

(52) U.S. Cl. ..... 482/54; 482/51; 184/15.1

(58) Field of Classification Search ..... 482/51, 482/54; 119/700; 434/247; 184/6.1, 6.21, 184/12, 14, 15.1, 15.3, 16–18, 101, 102; 474/91, 237, 273; 198/493, 500, 501, 841
See application file for complete search history.

(56) References Cited

U.S. PATENT DOCUMENTS 4,872,664 A * 10/1989 Parker ..... 482/54
5,509,872 A * 4/1996 Chen ..... 482/54
5,913,384 A * 6/1999 Williams ..... 184/15.1

* cited by examiner

*Primary Examiner*—Glenn Richman
(74) *Attorney, Agent, or Firm*—Troxell Law Office, PLLC

(57) ABSTRACT

A treadmill belt lubricating device for an electric treadmill comprises a transversal axle rod disposed at a frame of the treadmill, and a swinging lever longitudinally coupled to the axle rod, wherein an end of the lever includes an inertia weight, and the other end of the lever is coupled to a transversal U-shape retaining groove, and the retaining groove includes a wool felt, and a lubricant is filled into the wool felt, such that after the foregoing components are assembled, a roller is positioned precisely under the running board, and another end of the wool felt maintains a gap with the treadmill belt, and if the running board is vibrated, then the inertia swing of the lever weight drives the wool felt to be in contact with the bottom surface of the treadmill belt, so as to achieve the effect of constantly lubricating the treadmill belt.

4 Claims, 3 Drawing Sheets

TREADMILL BELT LUBRICATING DEVICE FOR AN ELECTRIC TREADMILL

BACKGROUND OF THE INVENTION

1. Fields of the Invention

The invention relates to a treadmill belt lubricating device for an electric treadmill, and more particularly to a treadmill belt lubricating device that constantly lubricates a treadmill belt to ensure a smooth running of the treadmill belt.

2. Description of the Related Art

In general, an electric treadmill usually uses a motor (not shown in the figure) and a transmission belt (not shown in the figure) to drive a roller, and the roller drives the treadmill belt to run, so that a user can successfully perform a running exercise on the treadmill. To support the user's body weight, a running board is installed under the treadmill belt, such that when a user is performing a running exercise, the bottom surface of the treadmill belt produces a friction with the corresponding surface of the running board. Since there is a friction produced between the treadmill belt and the running board, manufacturers usually have to coat a layer of lubricant on the surface of the running board to prevent excessive frictions created between the treadmill belt and the running board that will wear out or damage the treadmill belt.

Since the running board and treadmill belt keep rubbing with each other, the lubricant will be used up gradually, and the lubricating effect will diminish. Therefore, users have to ask the maintenance people of the manufacturer or distributor to apply lubricants to the treadmill and maintain the normal operation of the treadmill belt, after the treadmill has been used for a while. The lubricating process has to be done by an experienced technician, since many components (such as the protective bottom chassis, the roller, and the treadmill belt) of the treadmill have to be removed before the lubrication can be made. To avoid damages to the treadmill during the process of disassembling and reinstalling the components of the treadmill, it is recommended to ask professional people or experienced technician to handle the lubrication.

SUMMARY OF THE INVENTION

In view of the inconvenient lubricating procedure of the prior art, the inventor of the present invention based on years of experience in the related industry to conduct extensive researches, and finally invented a treadmill lubricating device for an electronic treadmill. Therefore, it is a primary object of the invention to add a retaining groove containing a lubricant, and use the retaining groove together with a wool felt having a good absorbability to provide a lubrication at the bottom surface of the treadmill belt, in addition to applying a lubricant to the surface of the running board before the electronic treadmill is shipped out of the factory. Such arrangement can greatly extend the effective lubricating time and reduce the trouble of lubricating the treadmill.

Another objective of the present invention is to allow users to add and refill the lubricant according to a simple and easy method to save unnecessary maintenance fee. In the present invention, an oil filling pipe is wrapped by a wool felt, and the oil filling hole of the oil filling pipe is disposed at an appropriate position on an external side of the retaining groove.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The technical characteristics, features and advantages of the present invention will become apparent from the following detailed description taken with the accompanying drawing.

Figure 1:
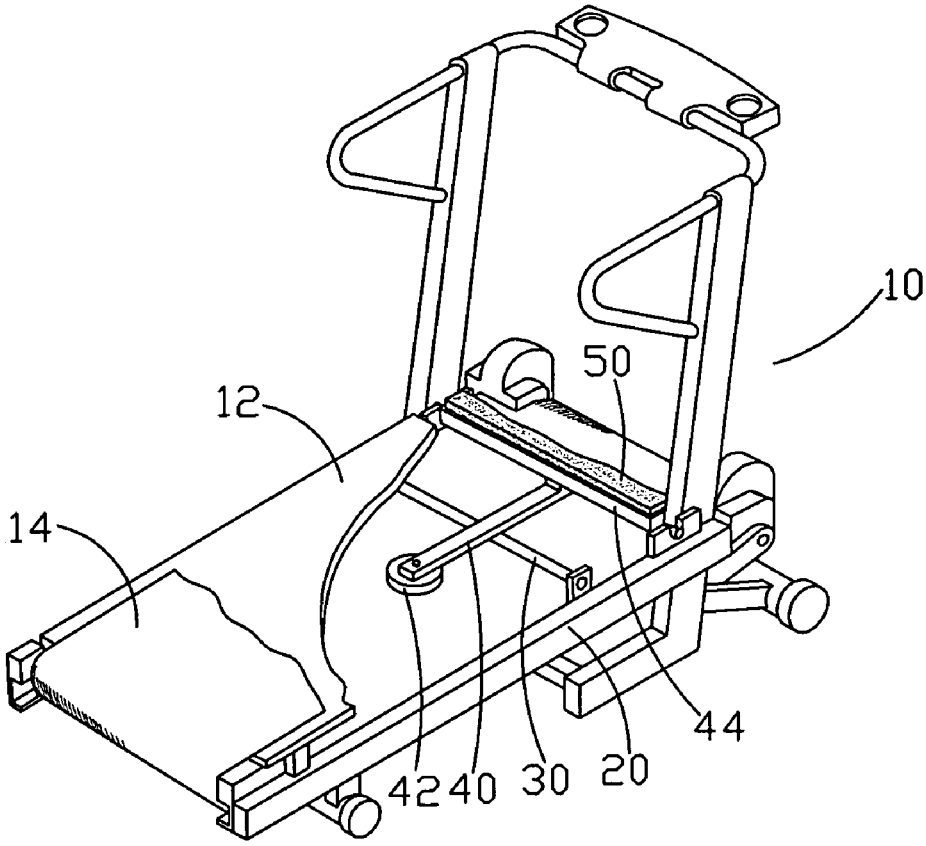
FIG. 1 is a perspective view of the present invention.
Figure 2:
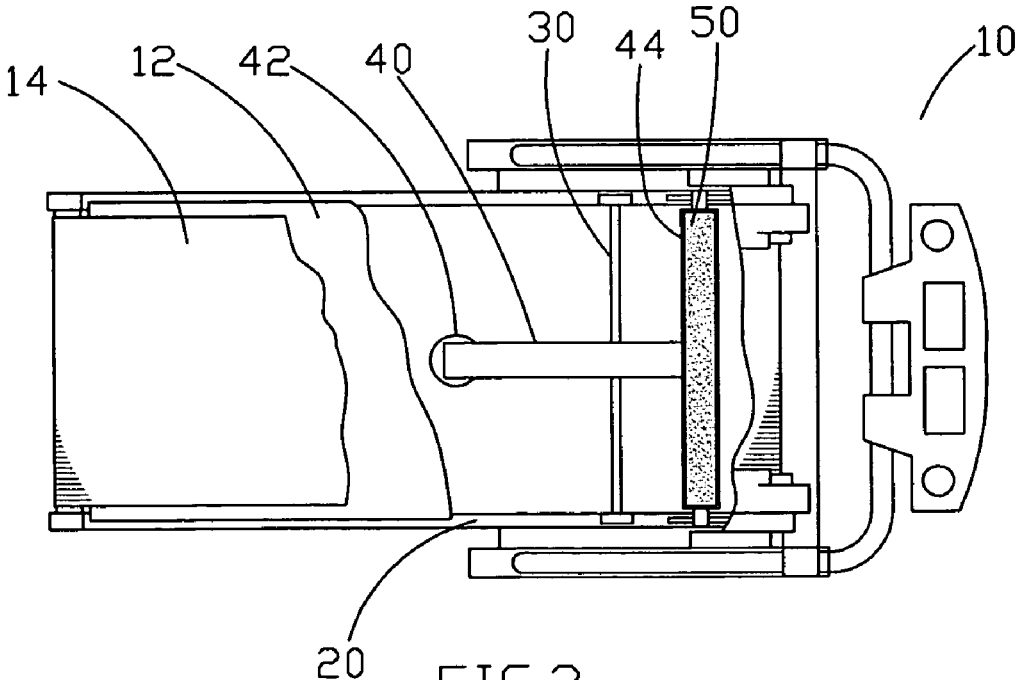
FIG. 2 is a bottom view of the present invention.
Figure 3:
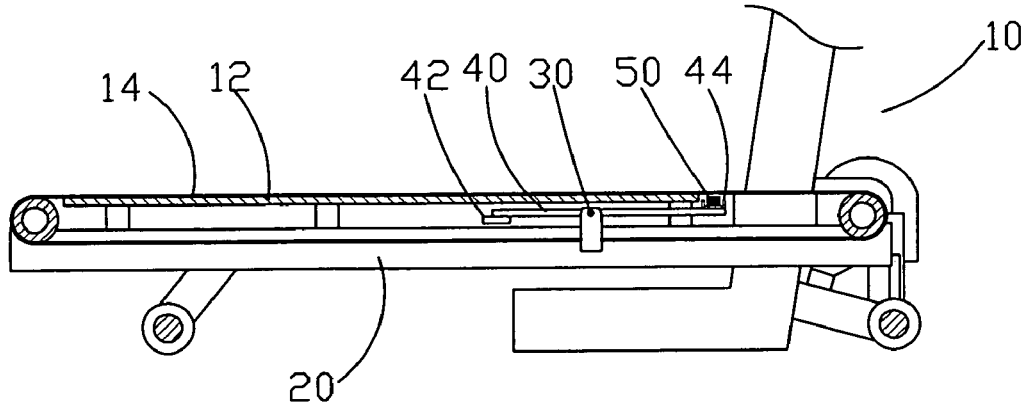
FIG. 3 is a side view of the present invention.

Referring to FIGS. 1 to 3, a transversal axle rod 30 is installed at an appropriate position on a frame 20 of a treadmill 10, and a swinging lever 40 is longitudinally coupled to the axle rod 30, wherein an end of the lever 40 includes an inertia weight 42, and the other end of the lever 40 is coupled to a transversal U-shape retaining groove 44, and the retaining groove 44 includes an appropriate quantity of wool felt 50 therein, and a lubricant is filled into the wool felt 50, such that after the foregoing components are assembled, the position of the weight 42 is situated precisely under the running board 12, and the other end of the wool felt 50 maintains an appropriate gap with the treadmill belt 14. If a user stands on the treadmill belt 14 and performs a running exercise, the weight repeatedly collides and vibrates the running board 12, and the vibration of the running board 12 indirectly drives the weight 42 to produce an inertia swing by transmitting the weight, such that the retaining groove 44 and the wool felt 50 at another end of the lever 40 swing upward and touch the treadmill belt 14. Such arrangement will repeatedly keep the wool felt 50 to be in contact with the bottom surface of the treadmill belt 14 and successfully coat the lubricant onto the bottom surface of the treadmill belt 14, so as to achieve the expected lubricating effect for a long time.

Figure 4:
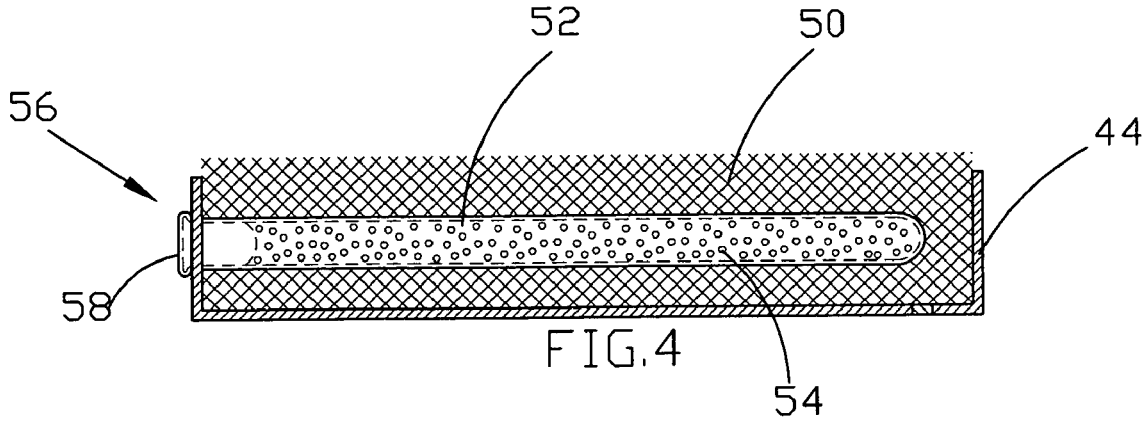
FIG. 4 is a schematic view showing the position of an oil filling pipe of the present invention.

Referring to FIG. 4, a user can add and refill lubricants according to a simple and easy method to save unnecessary maintenance fees, and thus the present invention further comprises an oil filling pipe 52 wrapped by a wool felt 50, and the oil filling pipe 52 includes a plurality of oil outlets 54 penetrated into the oil filling pipe 52, and an oil filling hole 56 of the oil filling pipe 52 is disposed at an appropriate position on an external side of a retaining groove 44, and a stopper 58 is provided for stopping the oil filling hole 56. When a user wants to add or refill the lubricant, the user just needs to open the bottom protective chassis (not shown in the figure) of the treadmill 10 and remove the stopper 58 to apply the lubricant. The invention is very convenient and useful.

Figure 5:
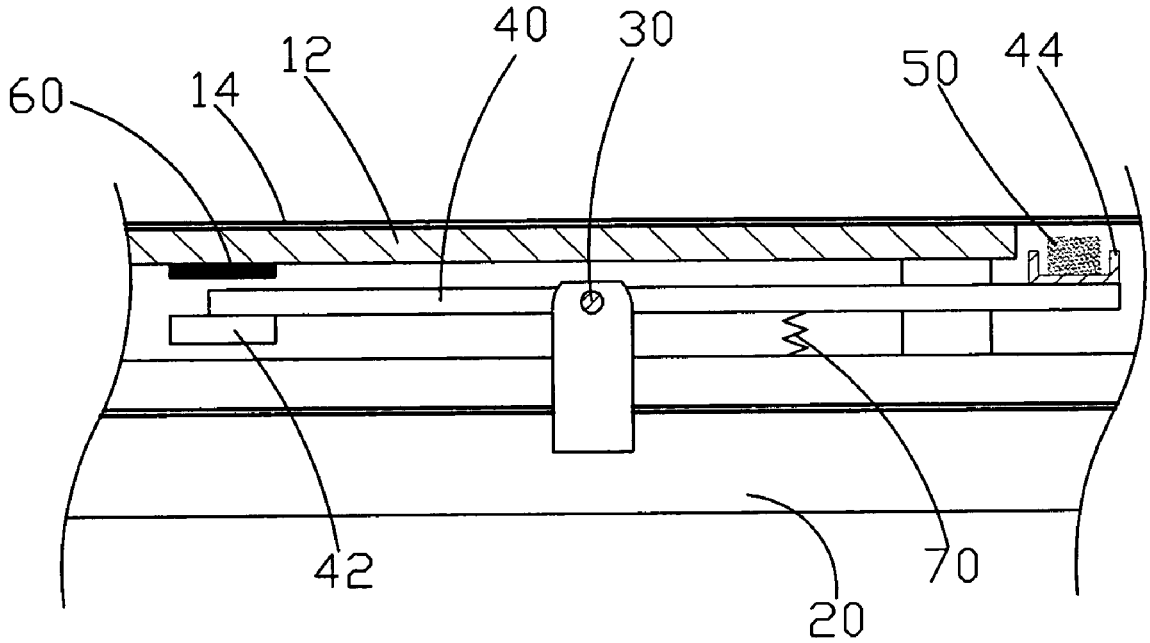
FIG. 5 is a schematic view of another preferred embodiment of the present invention.

Referring to FIG. 5, a soft pad 60 is installed at a corresponding position to fully absorb the collision force in order to effectively prevent possible continuous collisions between the lever 40 and the running board 12 or the continuous shaking of the lever 40, and a resilient member 70 also could be installed between the lever 40 and the frame 20 to achieve the same effect.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A treadmill belt lubricating device for an electric treadmill comprising:

a) an axle rod located on a frame of the treadmill;

b) a swinging lever pivotally connected to the axle rod and having:

i) an inertia weight located on a first end thereof; and ii) a retaining groove having a U-shape and being connected to a second end of the swing lever;

c) a wool felt located in the retaining groove; and d) a lubricant is located in the wool felt;

wherein the inertia weight is located under a running board of the treadmill, the wool felt selectively engaging the treadmill belt, and, when the running board is vibrated by an external force, an inertia swing of the inertia weight drives the wool felt to engage a bottom surface of the treadmill belt lubricating the treadmill belt.

2. The treadmill belt lubricating device according to claim 1, further comprising an oil filling pipe inserted into the wool felt and having a plurality of oil outlets penetrating the oil filling pipe and an oil filling hole located on an external side of the retaining groove.

3. The treadmill belt lubricating device according to claim 1, further comprising a soft pad located between the swing lever and the running board.

4. The treadmill belt lubricating device according to claim 1, further comprising a resilient member located between the swing lever and the frame.

* * * * *